US005966898A

United States Patent [19]

Su

[11] Patent Number: 5,966,898

[45] Date of Patent: Oct. 19, 1999

[54] EASY OPEN METHOD, PACKAGE, AND APPARATUS

[75] Inventor: Philip Su, North Point, The Hong Kong Special Administrative Region of the People's Republic of China

[73] Assignee: Cryovac, Inc., Duncan, S.C.

[21] Appl. No.: 09/086,463

[22] Filed: May 28, 1998

Related U.S. Application Data

[62] Division of application No. 08/491,205, Jun. 16, 1995, Pat. No. 5,806,280.

[51] Int. Cl.[6] ..... B65B 61/18

[52] U.S. Cl. ..... 53/133.8; 53/374.8; 53/557; 53/568; 156/515

[58] Field of Search ..... 493/194, 203, 493/204, 341; 156/251, 515; 53/412, 479, 133.3, 133.8, 373.7, 374.8, 374.9, 557, 568

[56] References Cited

U.S. PATENT DOCUMENTS

| | | |
|---|---|---|
| Re. 30,010 | 5/1979 | Shanklin . |
| 3,273,302 | 9/1966 | Walter . |
| 3,403,840 | 10/1968 | Mathes . |
| 3,456,780 | 7/1969 | Forman . |
| 3,470,795 | 10/1969 | Davis, Jr. . |
| 3,516,537 | 6/1970 | Dreyfus et al. . |
| 3,550,764 | 12/1970 | Tigner . |
| 3,641,732 | 2/1972 | Fujio . |
| 3,663,239 | 5/1972 | Rowe et al. . |
| 3,764,351 | 10/1973 | Whittington et al. . |
| 3,877,633 | 4/1975 | Peck et al. . |
| 4,007,838 | 2/1977 | Awad . |
| 4,219,988 | 9/1980 | Shanklin et al. . |
| 4,328,895 | 5/1982 | Jaeger . |
| 4,353,770 | 10/1982 | Kuckhermann . |
| 4,394,204 | 7/1983 | Hutcheson . |
| 4,657,792 | 4/1987 | Ausnit . |
| 4,861,414 | 8/1989 | Vogan . |
| 4,946,431 | 8/1990 | Jensen . |
| 4,958,735 | 9/1990 | Odabashian . |
| 5,048,687 | 9/1991 | Suzuki et al. . |
| 5,080,643 | 1/1992 | Mitchell et al. . |
| 5,129,518 | 7/1992 | Tanaka et al. . |
| 5,177,931 | 1/1993 | Latter . |
| 5,334,272 | 8/1994 | Takata et al. . |
| 5,371,997 | 12/1994 | Kopp et al. . |
| 5,375,718 | 12/1994 | Honma et al. . |

FOREIGN PATENT DOCUMENTS

| | | |
|---|---|---|
| 2 480 713 | 4/1981 | France . |
| 2 077 688 | 4/1981 | United Kingdom . |

OTHER PUBLICATIONS

Packaging Week, Nov. 24, 1984.

Openable Label System FH–11–0 Model & FT–4OE Daily Dishes & Luncheons Series, pp. 1–5.

*Primary Examiner*—Daniel B. Moon

[57] ABSTRACT

A method of packaging an article comprises wrapping the article in a plastic film; and heat sealing the film using a sealing apparatus comprising a main sealing element, and a second sealing element attached at an angle to the main sealing element, and shorter than the main sealing element, such that when the film is sealed, a sealed notch that can be used to initiate opening of the package is made. A package comprises an article wrapped in a plastic film, the film being heat sealed to form a seal, the seal comprising a main seal, and a second seal attached at an angle to the main seal, and shorter than the main seal, and defining a sealed notch that can be used to initiate opening of the package. A sealing apparatus for making an easily opened package comprises a main sealing element, and a second sealing element attached at an angle to the main sealing element, and shorter than the main sealing element, and capable of creating a sealed notch that can be used to initiate opening of the package.

1 Claim, 6 Drawing Sheets

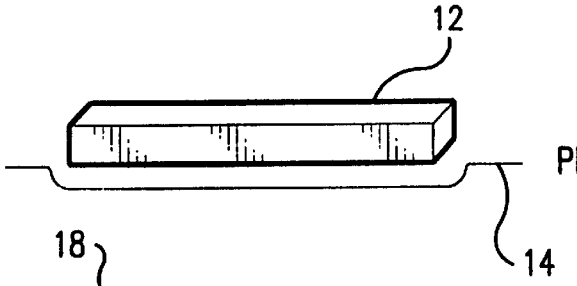
FIG.1
PRIOR ART
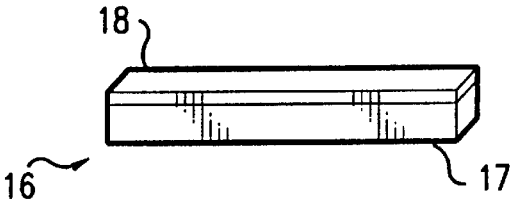
FIG.2
PRIOR ART
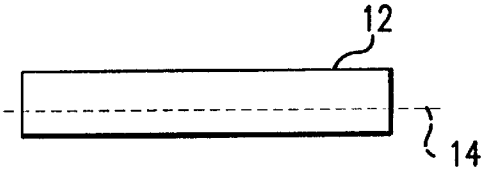
FIG.3
PRIOR ART
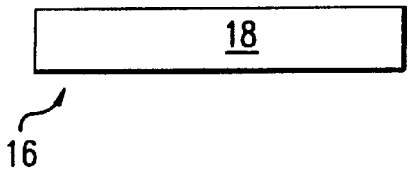
FIG.4
PRIOR ART
FIG.5
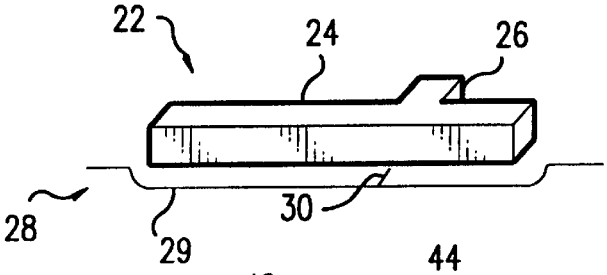
FIG.6
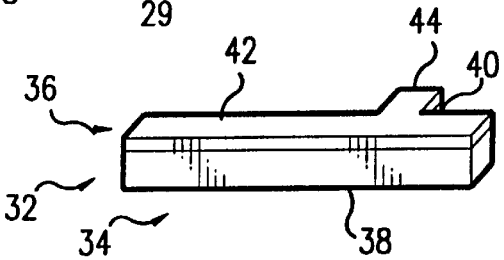
FIG.7
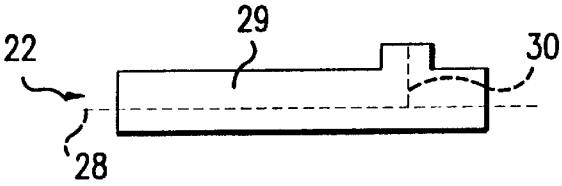
FIG.8
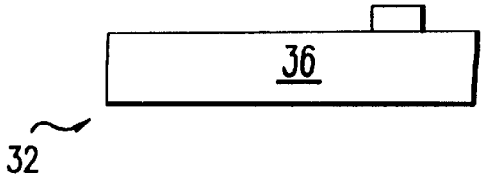

EASY OPEN METHOD, PACKAGE, AND APPARATUS

This is a divisional application Ser. No. 08/491,205, filed on Jun. 16, 1995, now U.S. Pat. No. 5,806,280.

FIELD OF THE INVENTION

The present invention relates to a method for making a package which can be easily opened, to an easily opened package, and to a sealing apparatus for making an easily opened package.

BACKGROUND OF THE INVENTION

Many packaging applications require the use of packaging materials, especially flexible packaging materials, that can be used to package food or non-food articles and protect these articles, during storage and distribution. Abuse resistance is thus often an important feature of the packaging material. Another property often desirable for such materials is heat shrinkability. In heat shrink packaging, an article is wrapped with a heat shrinkable polymeric film, typically a thermoplastic. The packaging material can be in the form of a bag, pouch, sheet folded in two ("centerfold film") or the like. The container formed by the film is loaded with the article to be packaged, and the film is then typically heat sealed (by constant heat type sealing or by impulse type sealing) or clip sealed along one or more edges of the film or bag to create a closed (hermetic or non-hermetic) package, followed by heat shrinking (e.g. by exposure to hot air or hot water) to provide a tight package. Heat shrinking not only adds aesthetic appeal; it also permits the packaging of articles with irregular shapes.

Film technology has progressed to the point where many films offer a high degree of abuse resistance and heat shrinkability. Examples include heat shrinkable films supplied by the Cryovac Division of W.R. Grace & Co.-Conn. These include D-955™, MPD-2055™, BDF-2001™, and other bag and film products.

Unfortunately, the same properties of toughness and abuse resistance that are desirable for the performance of the packaging material in protecting the contained article, often makes it difficult for the end user to open the package.

Various solutions to this problem have been proposed with a view to overcoming this problem and making it easier to open packages, especially heat shrunk packages, of the type just described.

One proposal calls for a line of perforations in a specific part of the film so that the package can be opened by tearing along the perforated line. This proposal suffers from the inherent weakening of the packaging material that occurs when a line of perforations is made in the film. If the film is a heat shrink film, the perforations can grow in size upon heat treatment of the film, and contaminants can potentially get into the package through the holes. This of course could reduce or totally negate the commercial value of the contents.

Another proposal has been to make a U-shaped hole in a specified location on the film, and then attach a paper seal over the hole to form a seal label that serves as an aid in opening the package. The disadvantage of this approach is that it requires a special apparatus for opening the U-shaped hole. The use of paper seals also adds to the production costs.

Still another proposal has been to attach an "opening tape" to the package. This is inherently cumbersome, and again adds cost to the package.

For certain equipment applications where flexible packaging film, especially heat shrink film, is used frequently, these proposals are extremely difficult to apply. This includes L-type sealer packaging machines which use centerfold film.

It would therefore be of great benefit to the packaging industry to provide a method of making an easy open package wherein the method is very compatible with current packaging systems, and makes use of currently available packaging films, but without the drawbacks of past proposed solutions to this problem.

SUMMARY OF THE INVENTION

In one aspect, the invention is a method of packaging an article comprising wrapping the article in a plastic film; and heat sealing the film using a sealing apparatus comprising a main sealing element, and a second sealing element attached at an angle to the main sealing element, and shorter than the main sealing element, such that when the film is sealed, a sealed notch that can be used to initiate opening of the package is made.

In a second aspect, the invention is a package comprising an article wrapped in a plastic film, the film being heat sealed to form a seal, the seal comprising a main seal, and a second seal attached at an angle to the main seal, and shorter than the main seal, and defining a sealed notch that can be used to initiate opening of the package.

In a third aspect, the invention is a sealing apparatus for making an easily opened package comprising a main sealing element, and a second sealing element attached at an angle to the main sealing element, and shorter than the main sealing element, and capable of creating a sealed notch that can be used to initiate opening of the package.

DESCRIPTION OF THE DRAWINGS

In the drawings presented by way of illustration:

FIG. 1 is a perspective view of a prior art seal bar and element;

FIG. 2 is a perspective view of a prior art seal seat;

FIG. 3 is a plan view of a prior art seal bar and element;

FIG. 4 is a plan view of a prior art seal seat;

FIG. 5 is a perspective view of a seal bar and element in accordance with the invention;

FIG. 6 is a perspective view of a seal seat in accordance with the invention;

FIG. 7 is a plan view of a seal bar and element in accordance with the invention;

FIG. 8 is a plan view of a seal seat in accordance with the invention;

DESCRIPTION OF THE PREFERRED EMBODIMENTS

Figure 9:
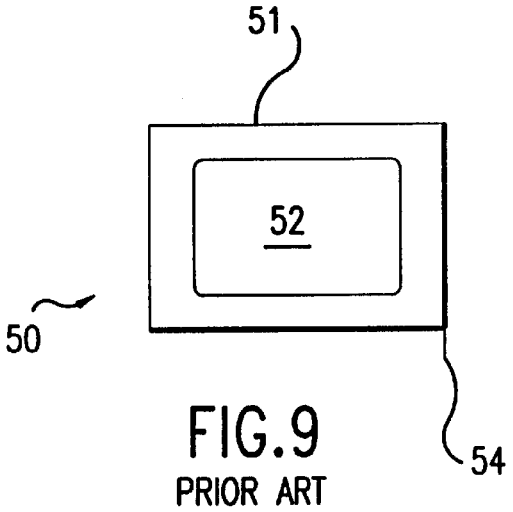
FIG.9 PRIOR ART
FIG. 9 is a schematic plan view of a prior art package.

In FIG. 1, a prior art impulse seal bar and element is shown. It includes a seal bar 12, and a sealing element 14 in the form of a wire. For the sake of clarity, the element 14 is shown spaced apart from the seal bar 12. In practice, the element 14 will typically be in contact with the underside of seal bar 12. Other components typical of such a system, such as a power source, electrical connections, and of course the components of the equipment within which this seal bay/seal element combination is now typically used, are well known and conventional and need no further description for those skilled in the art. The sealing element 14 is typically a single strand of wire, ribbon, band, etc., linear and straight in the portion where it interfaces with seal bar 12.

"Element" is used herein to mean a wire (round or otherwise in cross section), or a band, bar, ribbon, or the like, which can function to cause a seal to be made in thermoplastic film, by carrying heat to the film in e.g. a constant heat or impulse mode.

In the packaging industry, two of the principal types of heat sealing mechanisms are constant heat sealing and impulse sealing. In constant heat sealing, a seal bar is activated and thereafter during a packaging cycle is maintained at an elevated and pre-selected sealing temperature, whether or not it is being used at a particular moment to seal together e.g. two portions of thermoplastic film. For conventional constant heat L-bar sealers in particular, a heating element typically in the form of an L-shaped frame is pressed against the edge portions of a packaging film (typically centerfold film) enclosing an article, so that the film is fused together, sealed and cut off, to form a discrete package. In contrast, with conventional impulse sealing, a sealing element receives electrical impulses at predetermined times to fuse, seal, and cut off the edge portions of the film. The impulse seal element has a cooling system (or else cools simply by ambient air at some time during each sealing cycle), to intermittently cool the seal bar. The films used with both of these processes are typically, but not necessarily, shrink films.

FIG. 2 shows a prior art seal seat 16 which typically works in tandem with the above-described seal bar and element in an overall seal system. The seal seat includes a main portion 17 and an elastomeric pad 18.

FIG. 3 shows a plan view of a prior art impulse seal bar and element, i.e. a top view of the seal bar 12 and element 14 (mostly in phantom) of FIG. 1.

FIG. 4 shows a plan view of a prior art seal seat; only the elastomeric pad 18 is visible from this view.

FIG. 5 is a perspective view of a sealing apparatus in accordance with the invention. A seal bar 22 has in this particular embodiment a T shape, with a main section 24 and a relatively short (compared with the main section 24) second section 26. The second section 26 is attached to and extends at an angle from main section 24. The seal bar 22 accommodates a T-shaped sealing element 28 in the form of a wire. This sealing element has a main sealing element 29 and a relatively short (compared with the main element 29) second sealing element 30. The second sealing element 30 is attached to and extends at an angle from main sealing element 29. The elements can be made of any suitable material, such as nichrome alloy.

FIG. 6 is a perspective view of a seal seat 32 which works in tandem with the above-described seal bar and sealing element in the overall seal apparatus of the invention. The seal seat 32 includes a T-shaped main portion 34 and a T-shaped elastomeric pad 36. The T-shaped main portion 34 has a main section 38 and a relatively short (compared with the main section 38) second section 40. The second section 40 is attached to and extends at an angle from main section 38. Likewise, the elastomeric pad 36 has a main section 42 and a relatively short (compared with the main section 42) second section 44. The second section 44 is attached to and extends at an angle from main section 42. The elastomeric pad is typically an elastomer coated with a teflon or other insulating material.

It should be noted in these and other embodiments of the invention that respective main and second sections or elements can be attached in the sense of bringing together originally separate parts, or can be originally made in a single piece or part to form the intended final configuration.

FIG. 7 shows a plan, i.e. top view of the seal bar 22, and sealing element 28 (mostly in phantom), of FIG. 5.

FIG. 8 shows a plan, i.e. top view of the seal seat 32 and the elastomeric pad 36 of FIG. 6; only pad 36 is visible from this view.

FIG. 9 is a schematic plan view of a prior art package 50 made from a thermoplastic film 51, containing an article 52 and a heat seal 54; this package could be made from a flexible film such as a heat shrinkable film. No easy open tear mechanism is present. The seal 54 can be made in a variety of conventional ways, and can be a very thin sealed line made from a wire (e.g. trim seal as shown here), or a wider sealed area or band. Package 50 is shown with four sides, forming a quadrilateral (in plan view) package. Those skilled in the art will understand that a package can have any number of sides and various shapes; can have rounded, straight, or irregular sides; one or more sides are typically heat sealed; in the case of centerfold film used in L-bar sealers, three sides are heat sealed, and the fourth side (in a four sided package) is the fold created when a lay flat film from rollstock is initially folded on itself to create the centerfold film. Bags typically include one or two factory seals, and one or two folded sides; one side, the open mouth of the bag adapted to receive an article, is heat sealed after loading the article into the bag.

Figure 10:
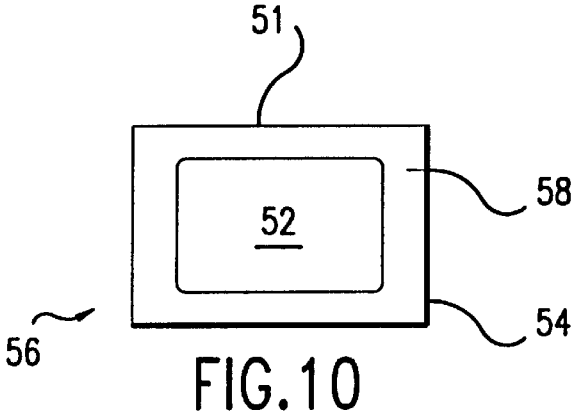
FIG. 10 is a schematic plan view of an easy open package in accordance with the invention.

FIG. 10 is a schematic plan view of an easy open package 56 in accordance with the invention. This package would also be made from a flexible film 51 such as a heat shrinkable film, but also includes a sealed notch 58. This sealed notch allows the user to grip the package and initiate tear at the notch. The natural tear propagation of many commercial films will then allow the package to be torn open, and allow easy access to article 52. Article 52 can be a food or non-food product.

Figure 11:
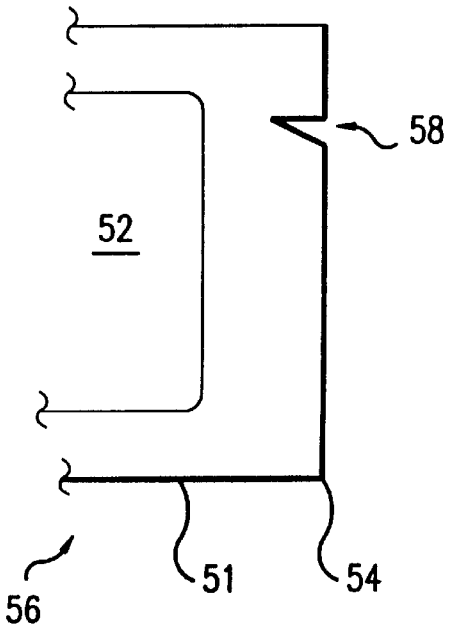
FIG. 11 is an enlarged schematic plan view of the package of FIG. 10.

FIG. 11 is an enlarged view of the package of FIG. 10. The exact shape, size, placement and configuration of sealed notch 58 can vary from package to package, or with package type, while still gaining benefit from it.

Figure 12:
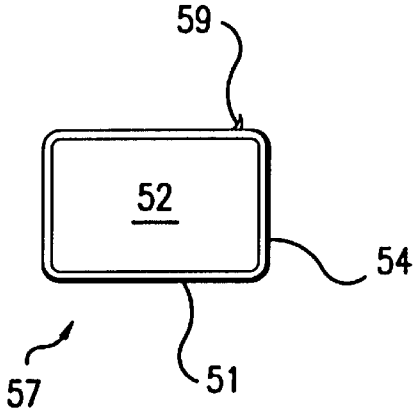
FIG. 12 is a schematic plan view of of the package of FIG. 10 after heat shrinking the package.

FIG. 12 shows a package 57 which represents package 56 after it has passed through a heat shrink tunnel or is otherwise heat shrunk, in the case of film 51 being a heat shrinkable film. A tear tab 59 will form somewhere on the package, and can be used to initiate opening the package by gripping and pulling back the tear tab.

Figure 13:
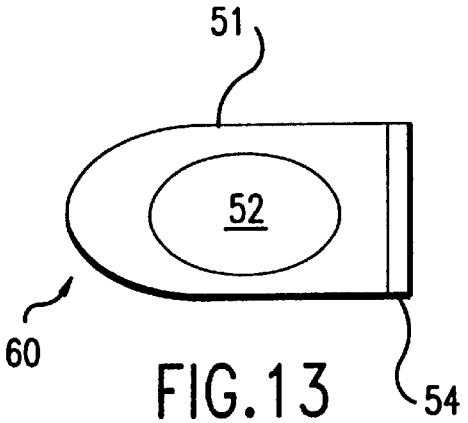
FIG.13 PRIOR ART
FIG. 13 is a schematic plan view of another prior art package.

FIG. 13 is a schematic plan view of another prior art package 60 containing an article 52 and a heat seal 54; this package could be made from a flexible bag such as a heat shrinkable bag, in turn made from a film 51. No easy open tear mechanism is present.

Figure 14:
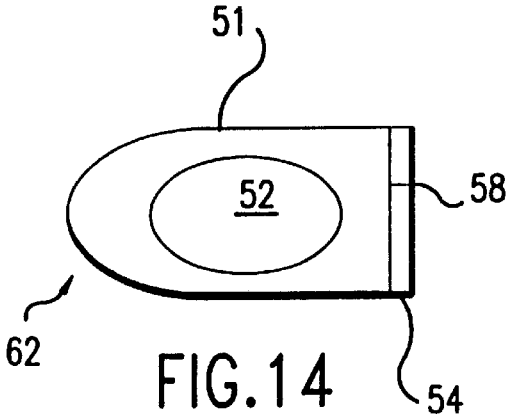
FIG. 14 is a schematic plan view of another easy open package in accordance with the invention.

FIG. 14 is a schematic plan view of another easy open package 62 in accordance with the invention. This package would also be made from a flexible film such as a heat shrinkable film, made into the form of a bag as shown, but also includes a sealed notch 58.

Figure 15:
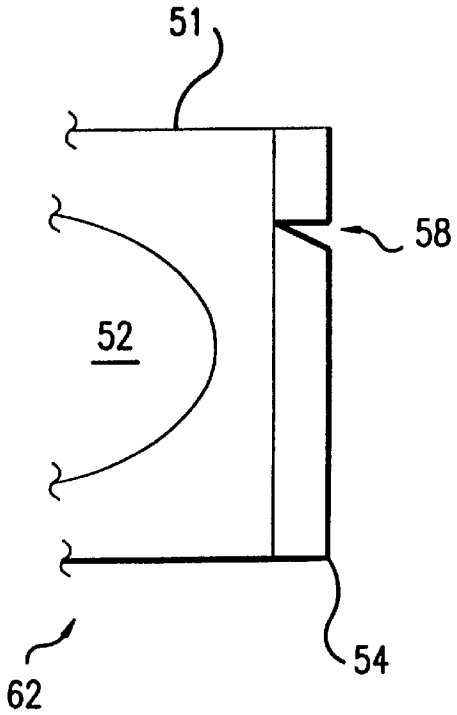
FIG. 15 is an enlarged schematic plan view of the package of FIG. 14.

FIG. 15 is an enlarged view of the package 62 of FIG. 14. The exact shape, size, placement and configuration of sealed notch 58 can vary from package to package, or with package type, while still gaining benefit from it.

Figure 16:
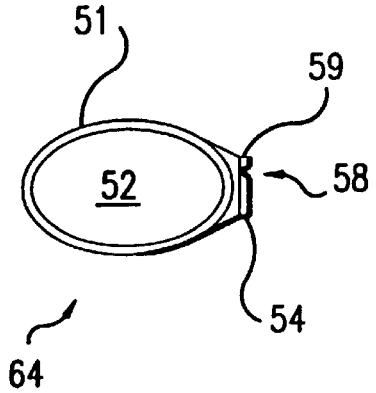
FIG. 16 is a schematic plan view of of the package of FIG. 14 after heat shrinking the package.

FIG. 16 shows a package 64 which represents package 62 after it has passed through a heat shrink tunnel or is otherwise heat shrunk, in the case of film 51 being a heat shrinkable film. A tear tab 59 will form in the vicinity of sealed notch 58, and can be used to initiate opening the package by gripping and pulling back the tear tab.

Figure 17:
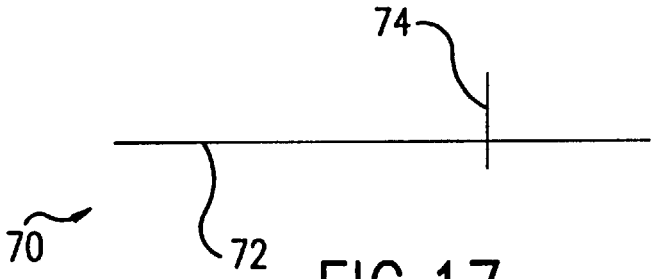
FIG. 17 is a schematic of a sealing apparatus in accordance with the invention.

FIG. 17 is a schematic of the sealing apparatus 70 in accordance with the invention. It includes a main sealing element 72, and a second relatively short (compared with the main sealing element 72) sealing element 74 attached at an angle to the main sealing element, intermediate the ends of the main sealing element 72, such that when thermoplastic film is sealed together to form a package, a sealed notch is created in the package. The main sealing element is preferably straight, or else curved to adapt to the desired shape of the heat seal to be made in the packaging material. Likewise, the relatively short, second sealing element 74 is preferably straight, although it can be curved as well.

Figure 18:
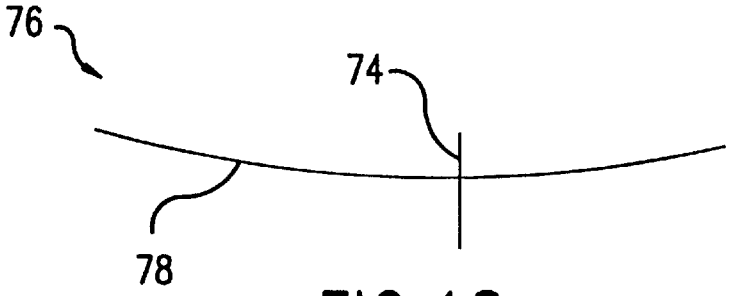
FIGS. 18–20 are schematics of alternative embodiments of a sealing apparatus in accordance with the invention.

An example of a sealing apparatus with a curved main sealing element 78 is shown in FIG. 18, where the sealing apparatus 76 has the main sealing element 78 and a second relatively short (compared with the main sealing element 78) sealing element 74 attached at an angle to the main sealing element, intermediate the ends of the main sealing element 78.

Figure 19:
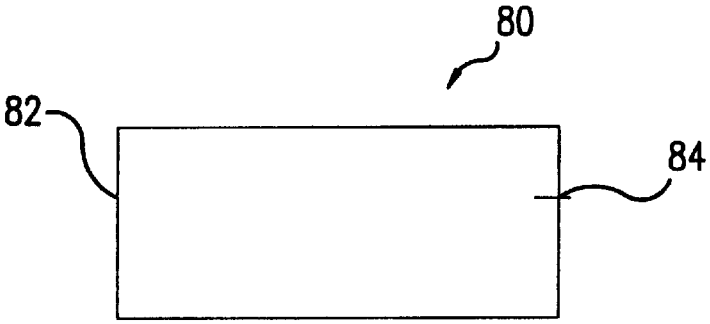

The main sealing element can also comprise a closed or partially closed loop 82, of any suitable shape, as shown in FIG. 19. The sealing apparatus 80 includes the main sealing element 82, and a second relatively short (compared with the main sealing element 82) sealing element 84 attached at an angle to one part of the main sealing element.

Figure 20:
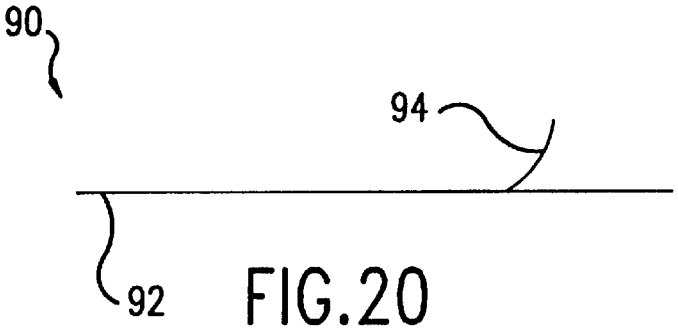

In general, the main sealing element and the second sealing element of the invention can be made from two distinct elements which are then attached together, by any suitable means such as soldering or welding. Alternatively, the main sealing element and the second sealing element can be made from a single wire, for example by die cutting from a single piece of material, with the second element extended from the main element at an angle to the main element. This latter embodiment is shown in FIG. 20. A sealing apparatus 90 includes a main sealing element 92, and a second relatively short (compared with the main sealing element 92) sealing element 94 projecting at an angle from the main sealing element, intermediate the ends of the main sealing element 92.

Whatever the particular embodiment, the second element can be disposed at any suitable angle with respect to the main element. Preferably, the second element forms an acute angle, i.e. is not perpendicular with respect to the main element. This will facilitate subsequent tearing of the package to open it. The choice of angle will depend on many factors, such as the toughness of the packaging material, the tear propagation of the material, etc. The second element can be placed at any location along the main element, and is preferably intermediate the ends, but more towards one end, of the main element so that in effect an easy open tear off corner is provided.

Figure 21:
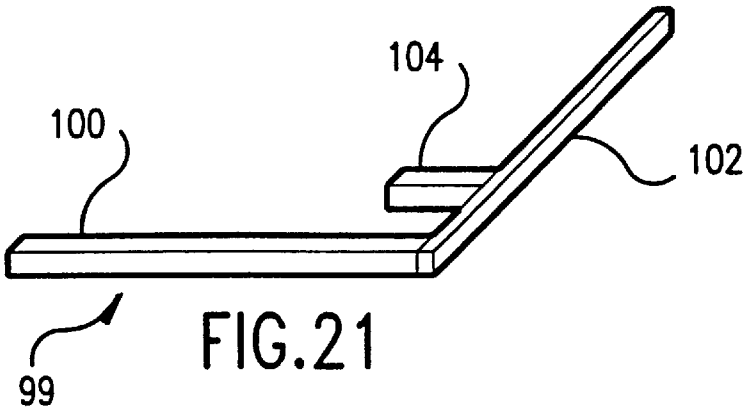
FIG. 21 is a perspective view of another alternative embodiment of a sealing apparatus in accordance with the invention.

FIG. 21 shows a perspective view of an alternative embodiment of a sealing apparatus in accordance with the invention. It includes an L-shaped main sealing element 99 comprising a first section 100 and a second section 102, and a second relatively short (compared with the second section 102) sealing element 104 attached at an angle to the main sealing element section 102, and intermediate the ends of the main sealing element section 102, such that when thermoplastic film is sealed together to form a package, a sealed notch is created in the package. The main sealing element sections 100 and 102 are preferably straight, or else curved to adapt to the desired shape of the heat seal to be made in the packaging material. Likewise, the relatively short, second sealing element 104 is preferably straight, although it can be curved as well.

Figure 22:
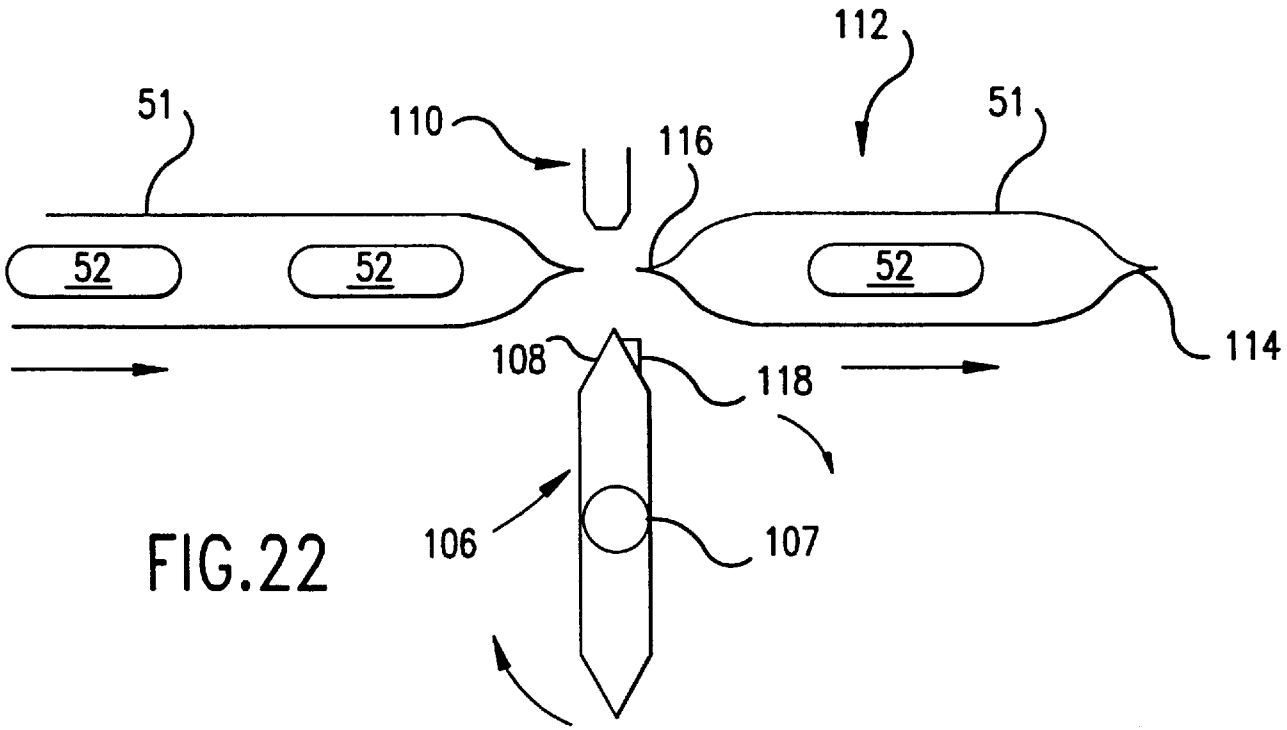
FIG. 22 is a schematic side view of a pillow type packaging system modified in accordance with the invention.
Figure 23:
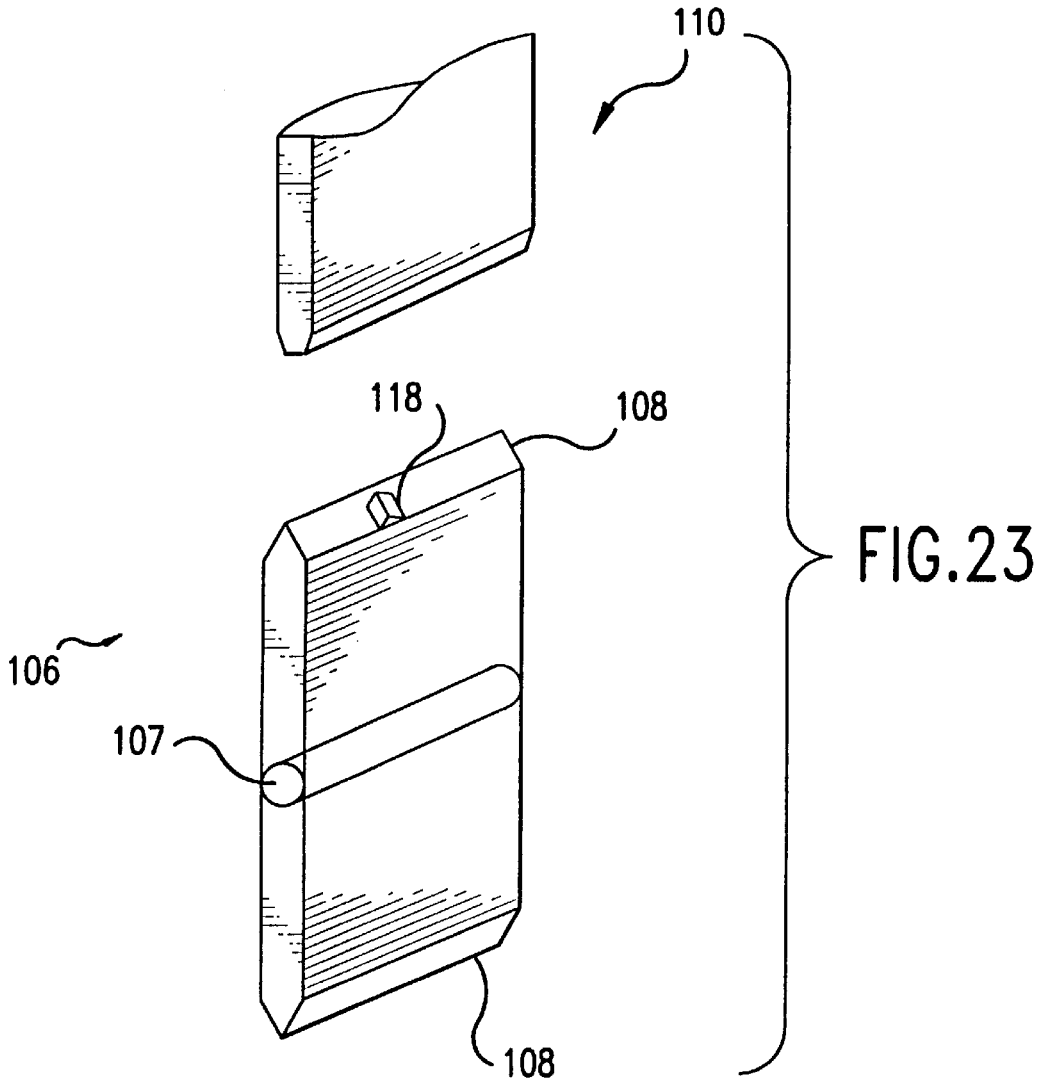
FIG. 23 is a perspective view of the sealing/cutting bars of the system of FIG. 18 in accordance with the invention.

FIG. 22 shows the invention in use in connection with a typical pillow pack packaging system. These systems are per se conventional and well known in the art. In such systems, a rollstock (flat) film is fed from a feed roll, and formed into a tube surrounding units 52 of the article to be packaged. This is essentially a horizontal form/fill/seal type system. Gas flushing or modified atmosphere packaging is an option in such systems. At a sealing/cutting station, the tubular film carrying an article is sealed together by a rotary sealer 106 which acts against the tubular article-containing film as the film advances (pictured in FIG. 22 as advancing from left to right). The sealing head 108 of the rotary sealer 106 acts against a complimentary knife or anvil 110 to seal and sever the film (the various components of FIG. 22 are shown as spaced apart from each other, in some cases to an exaggerated extent, for purposes of clarity). As the operation proceeds, discrete packages 112 are produced, having been sealed on their advanced side 114, and then on the trailing side 116 by subsequent rotation (in the direction shown by the arrows) and activation of the rotary sealer about rotary sealer axis 107. In the modification forming part of this invention, a second relatively short (in comparison with sealing head 108) sealing element 118 is attached to and extends at an angle from the main sealing head 108 (best seen in FIG. 23). This causes a sealed notch to be created in the pillow pack package, thus providing an easy open package in a continuous, on-line arrangement. The short sealing element 118 can be affixed to one or both of sealing heads 108 of rotary sealer 106, depending on the length of package, number of sealed notches desired in each unit 112, etc. Clearly, modifications including multiple sealing heads and short sealing elements 118 can be employed. Heat supplied to the sealing heads, by conventional means, can be of the constant heat or impulse seal type.

Figure 24:
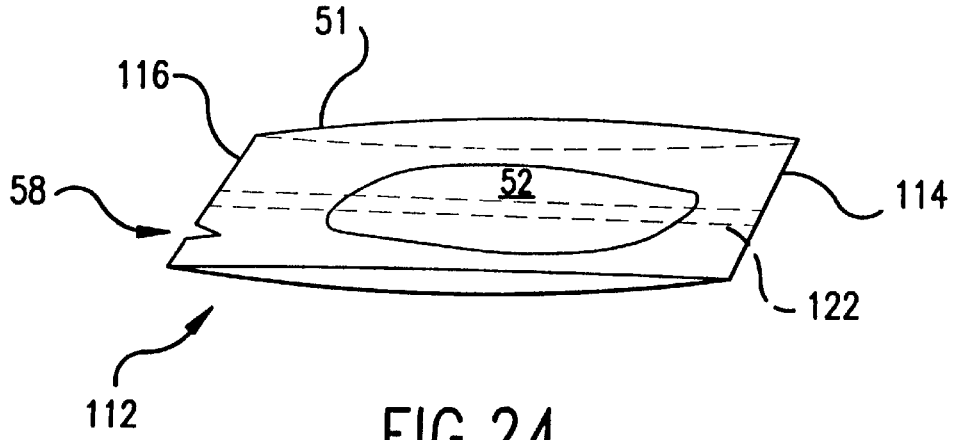
FIG. 24 is a perspective view of the pillow pack package of FIG. 24.

FIG. 24 shows in perspective the discrete pillow package 112 produced by this apparatus. A longitudinal seal 122 is typical of such a package.

This invention can be used in conjunction with currently available packaging equipment, including constant heat type, but especially impulse type sealing mechanisms.

This invention can be used with benefit in L-bar sealers such as those available from Heat Seal, Benison, Lady Pack, Komet, Kalfass, and Clameo.

This invention can also be used in conjunction with currently available bag and pouch packaging equipment, such as Furukawa, Multivac, Koch, Trigon, and other bag and pouch filling and, sealing equipment. Such equipment includes rotary chamber vacuum packaging machines such as those used for packaging fresh red meat.

This invention can also be used in conjunction with currently available pillow pack packaging equipment, such as equipment available from Weldotron, Shanklin, Omori, Tokiwa, Ibaraki, Futaba, and Doboy.

It is relatively easy to implement, and of low cost.

It is to be understood that variations of the present invention can be made without departing from the scope of the invention, which is not limited to the specific embodiments and examples disclosed herein, but extends to the claims presented below.

For example, although the film as described herein is disclosed primarily as being heat sealed to itself to form a heat sealed package, the present invention can be used with benefit when two or more discrete films are brought together and sealed to form a package.

Any heat sealable films, especially olefinic films, can be used with benefit in this invention.

What is claimed is:

1. A sealing apparatus for making an easily opened package from a tube of plastic film with an open longitudinal side, comprising:

a) an L-shaped main sealing element, having i) a first section for sealing a longitudinal seal along said open longitudinal side of the tube of plastic film, and ii) a second section, perpendicular to the first section, for sealing a transverse seal across said tube of plastic film, and b) a second sealing element attached at an angle to the second section of the main sealing element, said second sealing element being shorter than, and disposed intermediate the ends of, the second section of the main sealing element; the second sealing element capable of making a sealed notch in the film that can be used to initiate opening of the package.

* * * * *